United States Patent [19]

Kaufman

[11] Patent Number: 4,546,863

[45] Date of Patent: Oct. 15, 1985

[54] PROTECTIVE SHIELD ATTACHE CASE

[76] Inventor: Henry Kaufman, 1020 E. 14th Pl., Los Angeles, Calif. 90021

[21] Appl. No.: 448,029

[22] Filed: Dec. 8, 1982

[51] Int. Cl.[4] ..... F41H 5/08

[52] U.S. Cl. ..... 190/102; 109/49.5; 190/900; 220/900; 89/36.05

[58] Field of Search ..... 2/2.5; 89/36 D; 109/1 R, 22, 23, 49.5; 190/101, 102, 110, 900, 901, 902; 224/153

[56] References Cited

U.S. PATENT DOCUMENTS

| | | | |
|---|---|---|---|
| 645,151 | 3/1900 | Weisenburger | 89/36 D |
| 1,666,878 | 4/1928 | Johnson | 190/900 |
| 1,706,387 | 3/1929 | Kramer | 109/25 |
| 1,940,900 | 12/1933 | Barnard | 190/902 |
| 3,023,794 | 3/1962 | Lifton | 190/901 |
| 3,762,345 | 10/1973 | Sgariglia, Jr. | 109/22 |
| 3,766,865 | 10/1973 | Cutler | 89/36 D |
| 3,783,449 | 1/1974 | Davis | 2/2.5 |
| 3,837,447 | 9/1974 | Honan | 190/110 |
| 3,855,898 | 12/1974 | McDonald | 109/49.5 |
| 4,236,657 | 12/1980 | Brunton | 224/153 |
| 4,303,184 | 12/1981 | Kloth | 190/110 |

OTHER PUBLICATIONS

Webster's Seventh New Collegiate Dictionary, "Armor," Magnet, Substantial, 1969, pp. 48, 508, 876.

"Plastic Armor Shields Police," Popular Science, Jun. 1954, p. 131.

*Primary Examiner*—Stephen C. Bentley

*Attorney, Agent, or Firm*—Fulwider, Patton, Rieber, Lee & Utecht

[57] ABSTRACT

An attache case constructed to serve as a protective shield against bullet fired from handguns, the case having separate and relatively movable top and bottom sections with the top section including a flexible sidewall with a pouch holding an armor plate releasably attached to the exterior side of the sidewall. A pair of hand straps are attached to the bottom section of the case.

1 Claim, 5 Drawing Figures

PROTECTIVE SHIELD ATTACHE CASE

BACKGROUND OF THE INVENTION

The present invention relates generally to an attache case and, more particularly, to an attache case that can be utilized as a protective shield against projectiles fired from handguns.

With the increase of violence in recent years, particularly violence involving the use of handguns, it has become important to safeguard one's self from injury in whatever manner possible. For diplomats, businessmen and other persons who normally carry an attache case, it has been proposed that the construction of the case include an internally mounted bulletproof armor plate. When an attache case of such construction is positioned between its user and an armed adversary, he is reasonably well protected from serious injury. An attache case of this construction is shown in U.S. Pat. No. 3,762,345.

Although an attache case of the type described in said patent provides a protective shield, it has several disadvantages associated with its performance, ease of use and reusability. The attache case has no convenient means for the user to grasp the case when desiring to hold it in position in front of his body for protection. Further, should the case be struck by a bullet, the bullet would pass through the exterior sidewall of the case before impacting the armor plate, thereby destroying the case and requiring the user to purchase another at great expense.

Finally, the blunt trauma or impact of the bullet against the armor plate may wrench the case from the user's grip or push the case into the body or face of the user, causing possible injury to the user. Of course, if as a result of the impact the user drops the case, he is exposed to serious injury from a second bullet.

It will therefore be appreciated that there has been a significant need for an attache case which can effectively and conveniently serve as a protective shield and which does not require total replacement when struck by a bullet. The present invention fulfills this need, and further provides other related advantages.

SUMMARY OF THE INVENTION

The present invention resides in a portable carrying case for protecting a user's body from bullets. The case includes a first section and a second section to define a volume therebetween for retaining articles to be transported, the first and second sections being separate and movable relative to each other to provide access to the volume. The first section has a flexible, impact dampening sidewall, and releasably attached to an outwardly facing side of the sidewall is an armor plate, the plate being substantially coextensive with the sidewall and being substantially impenetrable by conventional bullets discharged by handguns. Edge panels form a substantially rigid frame for supporting the flexible sidewall.

The armor plate is contained in a pouch releasably attached to the flexible sidewall, and is held by the pouch in a position immediately adjacent to and parallel with the flexible sidewall for coaction with the sidewall. Also provided are hand straps attached to an outwardly facing side of a sidewall of the second section which is in opposing relation to the flexible sidewall.

Other features and advantages of the invention will become apparent from the following detailed description, taken in conjunction with the accompanying drawings.

DETAILED DESCRIPTION

Figure 1:
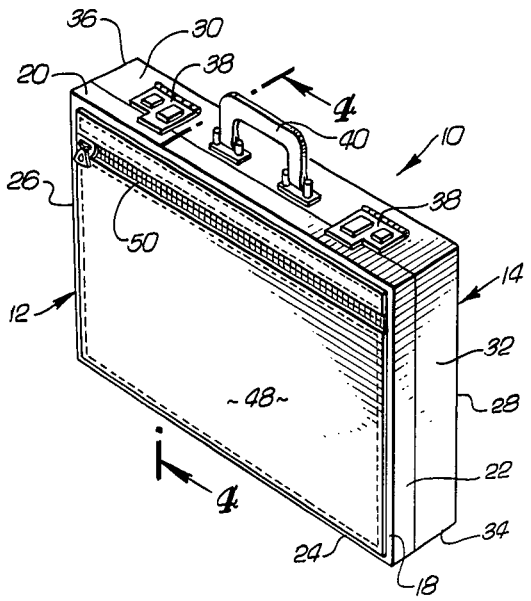
FIG. 1 is a perspective view of an attache case embodying the present invention, shown in a closed position.
Figure 2:
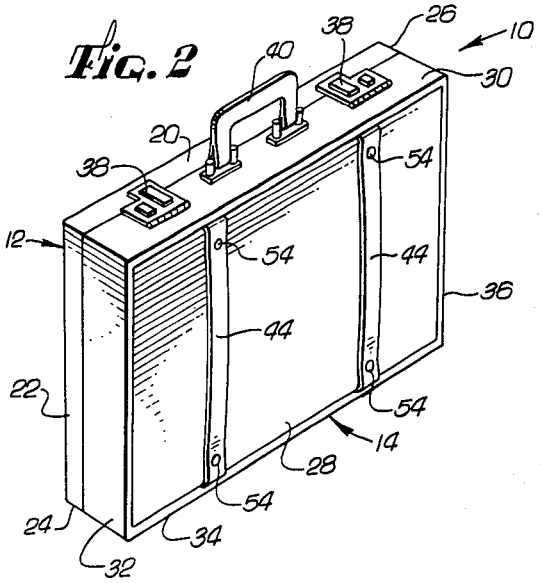
FIG. 2 is a perspective view of the case of FIG. 1, showing the bottom side of the case.
Figure 3:
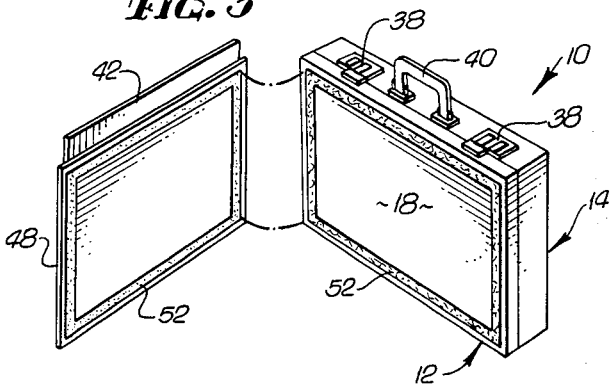
FIG. 3 is a reduced, perspective view of the case of FIG. 1, showing the pouch detached from the remainder of the case and the armor plate partially removed from the pouch.
Figure 4:
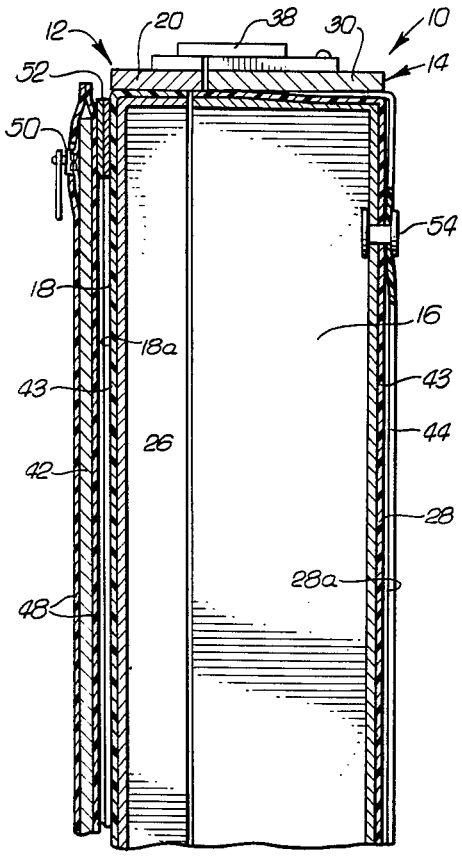
FIG. 4 is an enlarged, fragmentary, sectional view taken substantially along the line 4—4 of FIG. 1.

As shown in the drawings for purposes of illustration, the present invention is embodied in an attache case, indicated generally by reference numeral 10. The attache case 10 includes a top section 12 and a bottom section 14, with the sections defining a volume 16 therebetween for retaining articles to be transported. The top and bottom sections 12 and 14 are separate and movable relative to each other to provide access to the volume 16.

The top section 12 includes a substantially rectangular top sidewall 18 and top edge panels 20, 22, 24 and 26 extending around the perimeter of the top sidewall and projecting substantially perpendicularly therefrom toward the bottom section 14 when the case 10 is in a closed position. The top edge panels 20 and 24 are in opposing relation to each other, and the top edge panels 22 and 26 are in opposing relation to each other.

The bottom section 14 includes a substantially rectangular bottom sidewall 28 which is in opposing relation to the top sidewall 18 when the case is in the closed position. The bottom section 14 further includes bottom edge panels 30, 32, 34 and 36 extending around the perimeter of the bottom sidewall 28 and projecting substantially perpendicularly therefrom toward the top section 12 when the case 10 is in the closed position. The bottom edge panels 30 and 34 are in opposing relation to each other, and the bottom edge panels 32 and 36 are in opposing relation to each other.

A pair of conventional hinges (not shown) are each fastened at spaced apart locations to the top edge panel 24 and the bottom edge panel 34 to rotatably attach the top and bottom sections 12 and 14 together and permit their relative rotational movement. A pair of conventional lockable latch mechanisms 38 are each fastened at spaced apart locations to the top edge panel 20 and the bottom edge panel 30 to releasably hold the top and bottom sections 12 and 14 in fixed relation to each other when the attache case 10 is closed. A handle 40 is fastened to the bottom edge panel 30 for carrying of the attache case 10.

Figure 5:
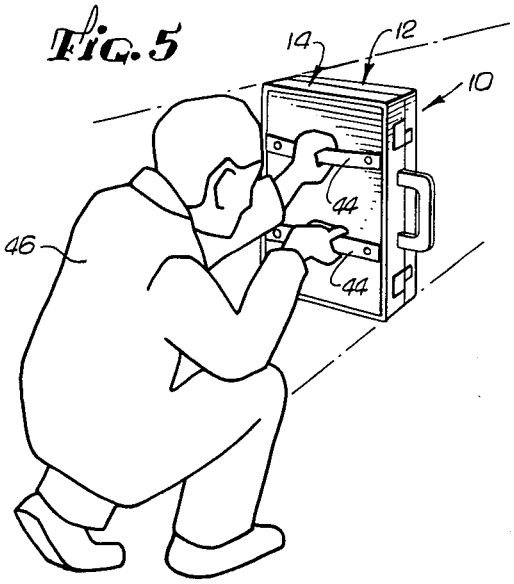
FIG. 5 is a reduced perspective view of the case of FIG. 1 being held by a user to shield his body.

In accordance with the invention, the top sidewall 18 is constructed of a flexible sheet of material secured along its edges to the top edge panels 20, 22, 24 and 26, which panels form a rigid frame for support of the top sidewall. A bullet resistant armor plate 42 is releasably attached to an exterior, outwardly facing side **18*a* of the top sidewall 18, and is substantially coextensive with the top sidewall. A pair of hand straps 44 are attached to an exterior, outwardly facing side 28*a* of the bottom sidewall 28, and provide a user 46 with a convenient means for grasping the case 10 and positioning it between his body and an armed assailant to serve as a protective shield against conventional bullets discharged from a handgun (see FIG. 5**).

The armor plate 42 is contained in a pouch 48 which may be provided with a zipper opening 50 along one edge portion of the pouch for insertion and removal of the armor plate. In an alternative embodiment, the armor plate 42 may be permanently sealed within the pouch 48. The pouch 48 is releasably attached to the exterior side 18*a* of the top sidewall 18 by mating strips of approximately one inch width "Velcro" 52 fixed to one side of the pouch along its perimeter, and correspondingly fixed to the exterior side of the top sidewall. In such manner, the armor plate 42 is positioned immediately adjacent to and parallel with the flexible top sidewall 18, and can coact with the sidewall upon being struck by a bullet.

The use of a flexible top sidewall 18 in conjunction with an armor plate 42 has been found to substantially reduce the blunt trauma or impact of a bullet striking the case 10, reducing the likelihood the user 46 will have the case wrenched from his hands or pushed into his body or face as a result of the impact of a first bullet hitting the case. It has further been found that the armor plate 42 is less likely to be penetrated by a bullet if used with an impact dampening flexible top sidewall 18. Increased user control of the case 10 as a protective shield both before and after the impact of a bullet is permitted by the hand straps 44.

In the presently preferred embodiment of the invention, the material used for the top sidewall 18 is a flexible paper fiberboard sheet. The bottom sidewall 28 and the top and bottom edge panels 20, 22, 24, 26, 30, 32, 34 and 36 may be constructed of wood or any other rigid material conventionally used in the construction of attache cases. By use of a flexible material for the top sidewall 18, the case of the present invention has the ability to withstand the impact of a bullet without shattering as would a case of wood construction. The exterior of the case 10, including the top sidewall 18, is covered with an expanded vinyl material 43.

The pouch 48 provides an aesthetically pleasing cover for the armor plate 42, and a satisfactory means to attach the armor plate to the exterior of the case 10. By so positioning the armor plate 42, damage to the case itself as a result of being struck by a bullet is minimized. A bullet stopped by the armor plate 42 will have only pierced the outward side of the pouch 48, without harming the remainder of the case 10. Consequently, the case 10 may be restored to its original state merely by removal of the damaged pouch 48 and replacement with a new pouch, avoiding the substantial expense of purchasing an entirely new case. While the armor plate 42 may be reused, it is advisable to replace it once struck by a bullet, and the used armor plate may be simply removed with the damaged pouch 48 and disposed of, and a new pouch and armor plate put in its place.

The armor plate 42 found satisfactory for use with the case 10 of the present invention is a type known as SS-6741 ballistic panel manufactured and sold by Swedlow, Inc. of 12122 Western Avenue, Garden Grove, Calif. With this type armor plate 42, the case 10 has successfully withstood conventional bullets discharged from handguns of 22 to 45 and 357 caliber. It should be understood that other conventional armor plate such as "Lexan" Polycarbonate manufactured by General Electric having a sufficient bullet resistance may also be used with the case, and benefit from the impact dampening design of the case. The beneficial results are believed particularly realized with armor plate 42 of the above-mentioned types which themselves flex under the impact of a bullet.

The hand straps 44 comprise strips of material positioned flatly against the bottom sidewall 28, and attached at each end to the bottom sidewall by rivets 54. The rivets 54 have relatively wide heads to minimize tearing of the hand straps or the bottom sidewall during use of the case 10.

From the foregoing, it will be appreciated that the invention, as described herein for purposes of illustration, provides an attache case which can be conveniently utilized as a protective shield and which reduces the adverse effects of bullet impact and enhances the bullet resistance of the armor plate used. Further, the attache case eliminates the need for the total replacement of the case when struck by a bullet. It will also be appreciated that, although specific embodiments of the invention have been described herein for purposes of illustration, various modifications may be made without departing from the spirit and scope of the invention. Accordingly, the invention is not limited except as by the appended claims.

I claim:

1. A hand-carrying case for protecting a user's body from bullets, comprising:

a portable case having a first section and a second section to define a volume therebetween for retaining articles to be transported, said first and second sections being separate and moveable relative to each other to provide access to said volume, said first section having an impact-dampening flexible sidewall and said second section having a sidewall in opposing relation to said flexible sidewall;

edge panels forming a substantially rigid frame for said first section for supporting said flexible sidewall;

an armor plate, said plate being essentially coextensive with said flexible sidewall and being impenetrable by conventional bullets discharged by handguns;

a pouch;

attachment means mounted to the perimeter of the outwardly facing surface of said flexible sidewall and to said pouch for releasably attaching said pouch to the outwardly facing surface of said flexible sidewall, said armor plate being disposed in said pouch and held thereby in a position immediately adjacent to and parallel with said flexible sidewall for coaction with said sidewall; and at least one hand strap attached to an outwardly facing side of said sidewall of said second section whereby the user may grasp said hand strap to position the case during use to protect his body from bullets.

* * * * *